US005787834A

United States Patent [19]

Holland

[11] Patent Number: 5,787,834

[45] Date of Patent: Aug. 4, 1998

[54] PORTABLE DOCKING LINE HOLDING DEVICE

[76] Inventor: Michael C. Holland, 745-C Espada, El Paso, Tex. 79912

[21] Appl. No.: 863,804

[22] Filed: May 27, 1997

[51] Int. Cl.[6] ..... B63B 21/00

[52] U.S. Cl. ..... 114/230; 119/790; 114/218

[58] Field of Search ..... 114/218, 221 R, 114/230; 119/790

[56] References Cited

U.S. PATENT DOCUMENTS

| | | | |
|---|---|---|---|
| 3,151,595 | 10/1964 | Strainbrook | 114/230 |
| 3,280,784 | 10/1966 | Stainbrook | 114/230 |
| 4,462,329 | 7/1984 | Brushaber | 114/230 |
| 4,479,454 | 10/1984 | Schepel | 114/230 |
| 4,676,182 | 6/1987 | Chaiko | 114/230 |
| 5,520,134 | 5/1996 | Walker | 114/230 |

*Primary Examiner*—Jesus D. Sotelo

[57] ABSTRACT

The Invention is portable device for holding a mooring line for use during boat docking maneuvers. The device is comprised of a portable, weighted base having a protruding, angled peg, over which is slipped a multi-segmented extension rod. The extension rod has on its top end a hooked section upon which the looped end of a docking line is hung. The device is placed on the surface of a dock near its edge, adjusted for height and fitted with the proper length of mooring line prior to the boat's departure. Upon the craft's return, the mooring line loop is grasped from the device's hooked end by a crewman standing on the deck of the boat, and slipped over a cleat on the boat. The boat's power can then be shut down and its occupants may safely disembark. With this device, the usual need for a crew member to jump from the moving deck of the boat in order to attach docking lines from the dock to the boat, is eliminated. So also is eliminated the risk of serious injury to a jumping crew member, and the risk of damage from a moving, unsecured boat. The device is portable, adjustable, resistant to the marine environment, simple to safely use, easy to fabricate and quickly removed from the dock for secure storage.

11 Claims, 4 Drawing Sheets

PORTABLE DOCKING LINE HOLDING DEVICE

FIELD OF INVENTION

BACKGROUND OF THE INVENTION

This invention will enable the rapid and safe docking and tie-up (mooring) of boats of all sizes in a marine environment, whether salt or fresh water. The concept is to present a portable and adjustable docking line holding device which will eliminate the need for having a person in the dock or the pier as the boat approaches. Such person would moor the boat by attaching ropes, cables, or lines to cleats on both the dock and the boat, resulting in the boat being secured to the dock so that its motion has ceased and its power may be shut down. In most cases, a second person is not available in the dock area to assist and it becomes imperative for a crewman to leap from the moving boat on to the dock to perform the tie-up. Often, the boat and dock surfaces are wet and slippery. An extremely dangerous situation is thus created, and many boaters have suffered serious injuries in leaping onto the dock. Some have even winded up in the water between the dock and the still-moving boat. The danger of the situation is increased greatly if it is the boat's captain who must leave the moving craft to perform the tie-up, leaving the craft unmanned but still moving. Similarly, crew injuries and property damage have occurred when a crewman was required to lean from the boat over the water in an attempt to grab the docking line or to snag it with a pole.

The prior art suggests several devices similar in function and purpose.

In U.S. Pat. No. 5,520,114, Walker requires the boatsman to drill into the dock surface to mount his device. In most marinas, this is not permitted. Also, Walker's apparatus does not hold the mooring line away from the dock so that the crewman does not have to dangerously lean out beyond the perimeter of the boat to grasp the line. Further, the Walker device does not have a means to adjust its height to suit a variety of boats, and it is not portable.

Chaiko, in U.S. Pat. No. 4,676,182, presents the docking line out over the water, but hangs a weight on a line from the tip of his device, which assuredly encumbers a safe docking procedure in the sense that the weight and its supporting line might be struck by the moving boat or its crew. The flexible limb under tension would appear to pose a risk of injury to the crewman attempting to remove the line. It is unclear how the weight is dispersed prior to the boat's departing its slip. Chaiko's device, too, requires permanent installation on the dock surface.

U.S. Pat. No. 4,479,454 describes Schepel's attempt to solve the unsafe mooring problem, but we are given a device that must be mounted permanently on the dock surface, and one that is not clearly adjustable. Further, one must ask whether the complex geometry of the multiple bore holes in the base can be understood by either the manufacturer or the user. Also, the "jam cleat" proposed by Schepel may not give up the docking line with ease in the few seconds the crewman has to grasp and attach it to the boat cleat while still under way.

Finally, Brushaber's device in U.S. Pat. No. 4,462,329 must be firmly affixed to a vertical surface and could jam in the "mounting member", thereby creating a hazard to both boat and crew. Many marinas have concrete pilings supporting their docks, and the Brushaber device simply could not work in such installations. Also, Brushaber would apparently permit the fastening of only a bow line, which would not act to halt the forward progress of the boat, and would therefore not alleviate one of the most dangerous aspects of docking.

All other devices found in the prior art appear to intend only to hold the boat securely at the dock.

SUMMARY OF THE INVENTION

This Invention is a portable mooring, or spring line holding device, comprising several distinct components which are easily separable. It includes a weighted base for stability. Such base is intended to rest in the surface of a dock or pier. The top face of the base includes a protrusion, or peg, upon which the other components are mounted. This peg is affixed to the base at an angle from the vertical such that when the remaining components of the Invention are attached, the end of a mooring line will be held out over the water and away from the edge of the dock.

Attached to the peg is a tubular riser, or extension rod, made up of one or more sections and a hooked end piece. The sections are designed to easily connect to the peg and to each other. Moreover, sections may be added to the extension rod or removed from it to vary the height at which the mooring line is held above the water. At the top of the extension rod is a hooked end piece, upon which the looped end of a mooring line is hung.

The combination of the peg's angle of attachment to the base and the length (height) of the extension rod permit the looped end of a mooring line to be held in a position over the water several feet above and away from the dock. The weighted base not only precludes its having to be permanently attached to the dock, but also provides a stable platform for the other components of the Invention and mooring line itself.

In practice, the weighted base of the Invention is positioned on the surface of the dock near its edge and its adjustable extension rod id raised appropriately. The other end of the docking line is securely fastened onto the existing cleat on the dock. A pre-determined length of the docking line is coiled on the dock so that once the looped end is fastened onto the boat cleat during the docking process, the boat will be positioned where the captain desires it to be upon stopping. These steps are taken before the boat leaves the dock so that all is in readiness for its return.

Upon docking, after the docking line is properly attached to the boat cleat and forward movement of the boat has ceased, the captain and crew can safely disembark from the craft and attach additional lines at the bow and stem of the boat. The initial docking line prevents the boat from drifting into and damaging what is ahead of it, or drifting back out into the harbor or lake. Depending in the size of the boat, the number of crewmen aboard and the desire of the captain, more than one Invention may be employed to aid in affixing additional docking lines. The Invention is uniquely simple, inexpensive, adjustable, mobile, partially buoyant and quickly collapsible for removal and storage.

OBJECTS OF THE INVENTION

It is an object of this Invention to provide a portable mooring line holder to be used during boat docking procedures, which does not require permanent fastening to the dock or pier.

It is a further object of this Invention to provide a stable and adjustable device which can hold and maintain a mooring line several feet out over the water from the dock and at a sufficient height so that a crew member on an approaching vessel can easily grab the end of the line and quickly attach it to a cleat on the boat without leaving the boat.

It is a further object to this invention to provide a device which is safe in its operation, in that it is sufficiently sturdy to reliably hold the spring line, yet is flexible and can easily move out of the way of an oncoming boat and its crew.

Still further, it is an object of this Invention to provide a device which is simple, economical and safe to manufacture and use. Other objects and advantages of this Invention will become apparent as the description proceeds.

DETAILED DESCRIPTION OF THE INVENTION

Figure 1:
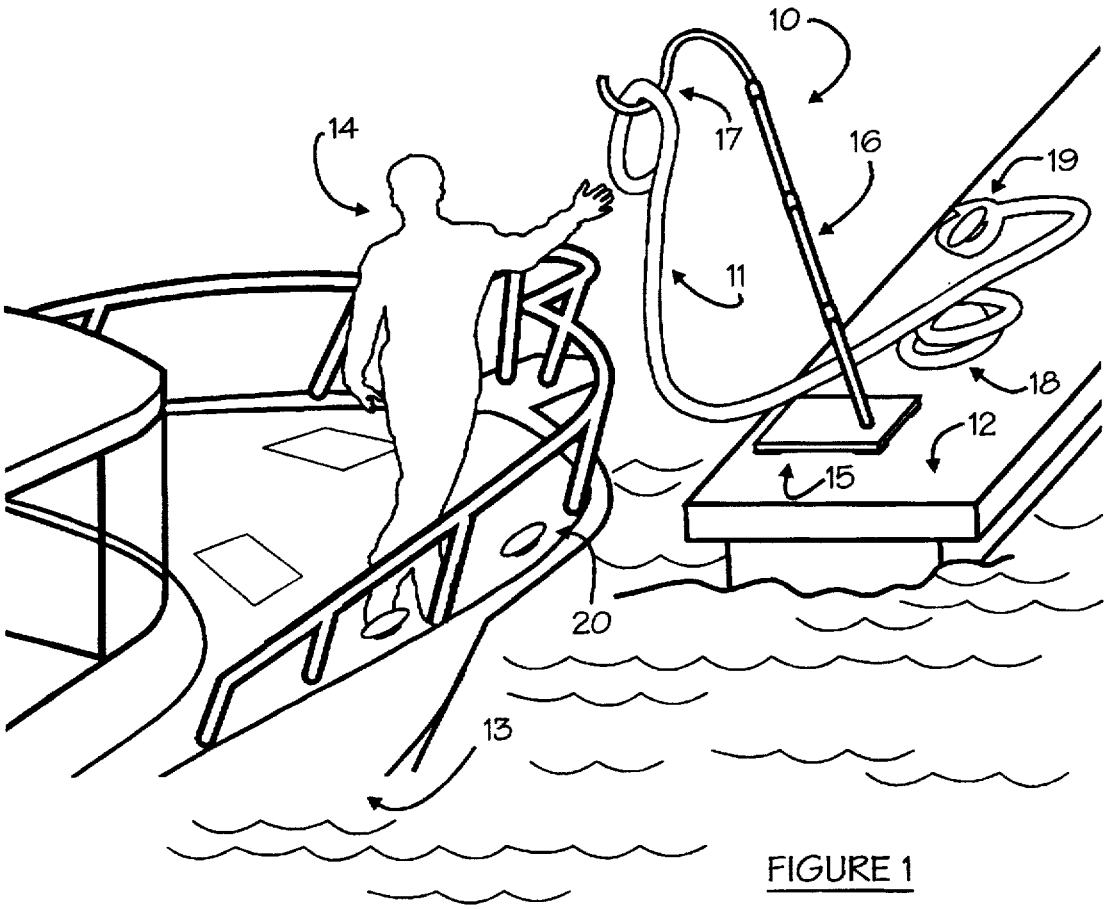
FIG. 1 is a perspective view of the Invention in operation.

Referring to the drawings in detail and initially to FIG. 1, the Invention 10 is shown situated on a dock 12 and presenting a mooring line 11. The two main components of the invention are a base 15 and an extension rod 16. At the top of the extension rod is a hooked end piece 17, upon which is hung the free, looped end of a docking line 11. The other end of the docking line is secured to a dock cleat 19 and a length of line is layed in a coil 18 on the dock. As the boat 13 approached the dock, the crew member 14 grabs the docking line loop and fastens it to the boat cleat 20. The boat is thus initially moored, and the crew can then safely disembark to attach additional lines.

Figure 4A:
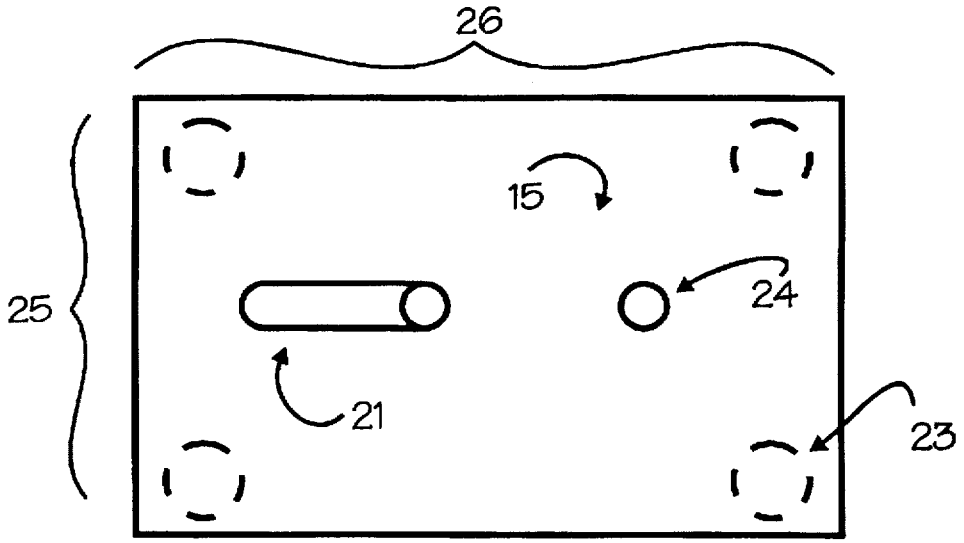
FIGS. 4*a* and 4*b* are top and side views of the base of the Invention.
Figure 4B:
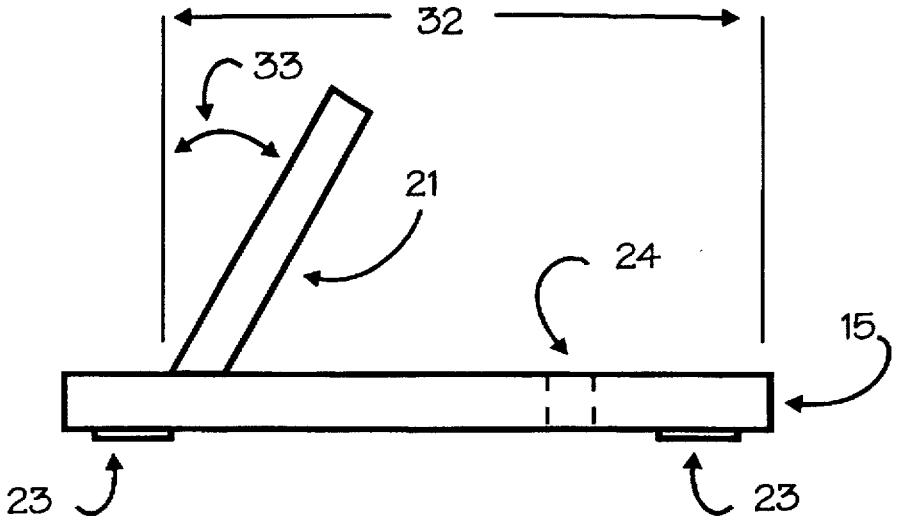

The base 15 is a weighted plate made from a dense and sturdy material, such as steel or cast iron. Other materials such as plastic encased cement could be used without departing from the spirit and scope of the Invention. The dimensions of the base will vary according to the amount of weight needed to provide the necessary stability. Attached to the top surface of the base is a peg 21 made of similarly sturdy material such as steel or cast iron, though other materials would also suffice. The peg is several inches long and is bonded to the base by a permanent process such as screwing into a threaded hole in the base, epoxy gluing or fillet welding. The peg is essentially centered in the narrow dimension 25 of the base as shown in FIG. 4*a*, and at a point a distance 32 from the edge of the base sufficient to provide a resistance to the turning moment created by the weight of the extension rod and docking line. The result is stability for the Invention. The peg is also mounted at an angle 33 from the vertical as shown in FIG. 4*b*. Such angle will likely be between 10 and 30 degrees. This allows the hooked end piece 17 of the extension rod to project a safe distance out beyond the edge of the dock. FIG. 4*a* and 4*b* also illustrate the placement of hole 24 in the base to facilitate manufacturing. Specifically, the base is hung by a hook placed in such hole while it moves along an assembly line for painting. It is also likely that the user will want to attach a security line to the Invention by means of said hole. FIGS. 4*a* and 4*b* also show the approximate placement of four "feet" 23 on the bottom surface of the base to impart non-skid properties. The portability and weight of the base and the placement of the peg are novel and unique features permitting effective use and removal of the Invention without need for modifications to the dock or pier for mounting.

Figure 2:
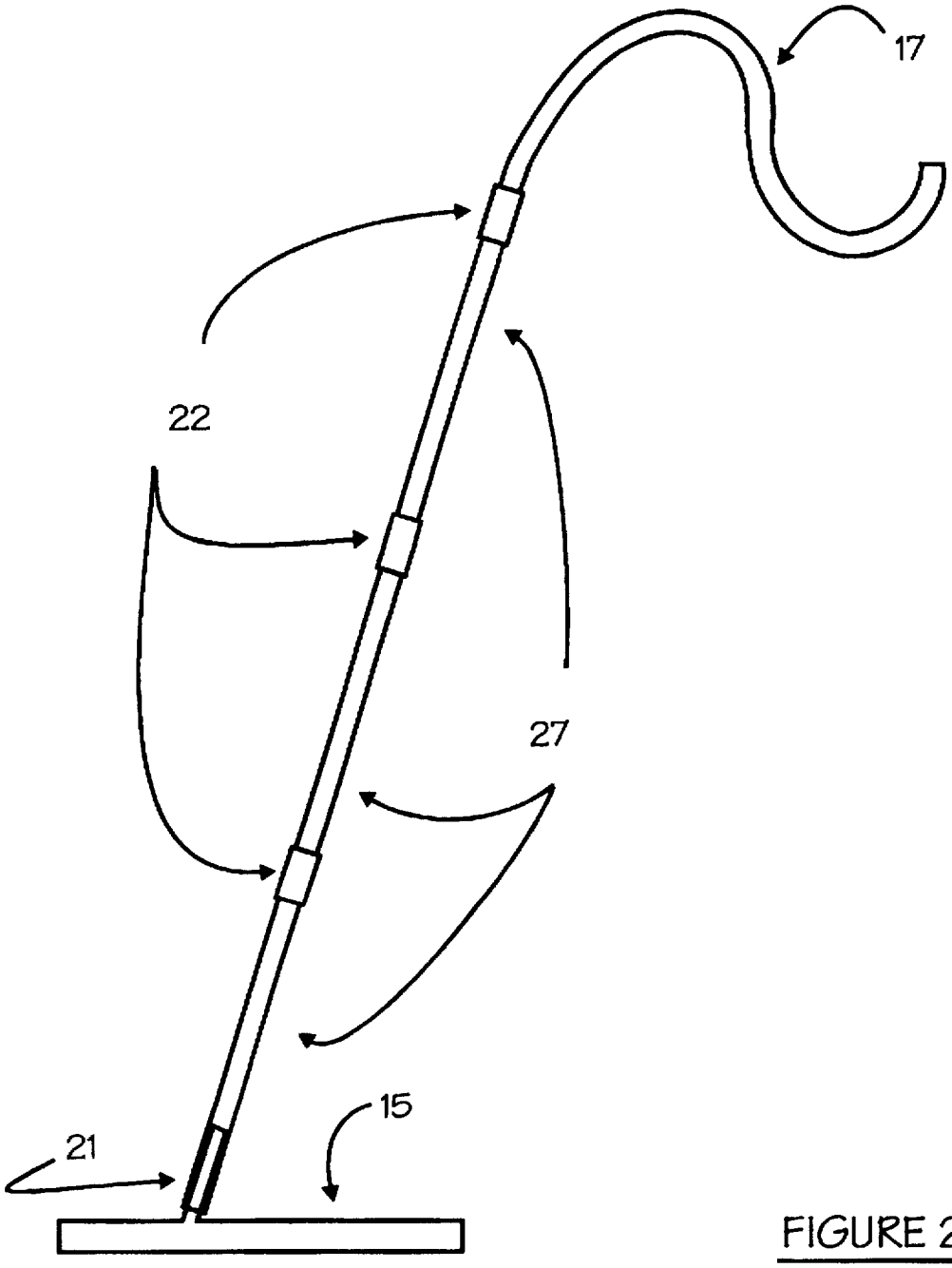
FIG. 2 is a side view of the Invention.

As FIG. 2 illustrates, the extension rod 16 component if the Invention consists of one or more sections 27, the upper-most of which is an S-shaped member called the hooked end piece 17. The lower most section is attached to the peg on the base by slipping its hollow end over said peg. Additional sections of the extension rod are fastened to each other by one of several alternative connectors 22, three of which are demonstrated schematically in FIGS. 3*a*, 3*b* and 3*c*. The extension rod sections and the hooked end piece are preferably made of lightweight and semi-rigid material, such as PVC plastic pipe or aluminum tubing. Composites and other materials could be used if they provided sufficient strength and flexibility.

Figure 3A:
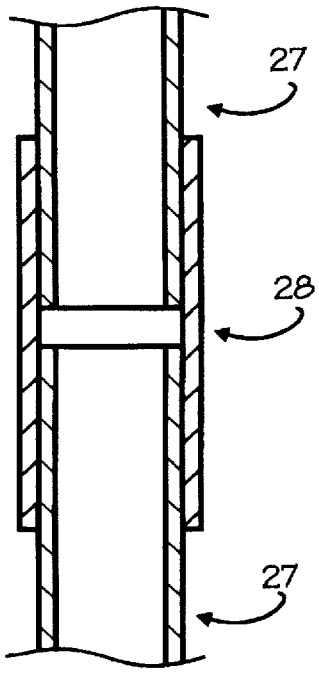
FIGS. 3*a*, 3*b* and 3*c* are cross-sectional views of several alternative connection means between the sections of the extension rod of the Invention.
Figure 3B:
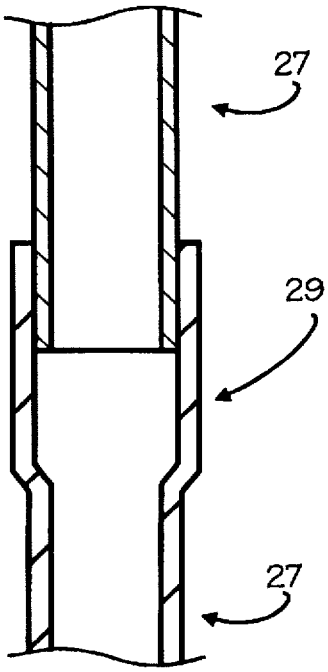
Figure 3C:
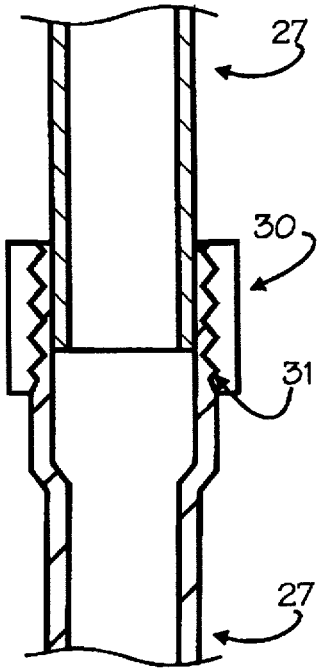

All components of the extension rod are hand fitted and can be easily assembled for use and disassembled for storage. FIG. 3*a* shows a sectioned view of a connector which is little more than a standard pipe coupler 28. Alternate ends of two sections 27 are friction fitted into each end of the coupler. FIG. 3*b* is s sectioned view of a connector variation which has one end of a section "belled" out 29 so that the alternate end of another section may be inserted into it without the need for a separate coupling device. FIG. 3*c* is a schematic rendering of a twist collar connector 30, which allows one section 27 to slip into another and be held at the desired position by tightening a threaded collar 31 on the end of the receiving section. All of these connectors are off-the-shelf items, readily available for use in the Invention. Other connection means can be used on the sections of the extension arm without departing from the spirit and scope of the Invention. Also, it is possible to plug the ends of each hollow section to provide buoyancy.

Given that the Invention is intended for use in a marine environment, corrosion prevention is a consideration. While a variety of satisfactory materials are available, the preferred coverings are vinyl or rubber paints applied over a suitable primer. Other possibilities include encasing the base in an epoxy, plastic or rubber material.

In operation, the Invention is both safe and highly portable. Specifically, the Invention is easily assembled and used. First, the base is placed feet down on a dock surface with the peg pointing toward the water. One or more sections of the extension rod are connected to each other, with the hooked end piece at the top, and the assembled rod is slipped over the peg on the base, all as shown in FIG. 2. At this point the looped end of the mooring line is (removed from the boat cleat and) hung from the hooked end piece at the top of the extension rod. The entire device is moved to the desired location on the dock. These activities are completed before the boat departs from the dock, allowing a check to be made of the precise positioning (height and distance over the water) of the docking line loop for safe retrieval upon the boat's return. The other end of the mooring line is tied to the dock cleat and the proper length of slack line is coiled on the dock.

Upon the return of the vessel, the looped end of the mooring line is simply removed from the hooked end piece by a crew member on the boat and slipped over the appropriate cleat on the boat. At this point, the boat's docking position is established and the crew may casually exit the boat to complete the securing of the boat.

One of the primary advantages of the Invention is that in the event the boat or crew member makes contact with it during the docking process, no damage or injury will occur because the Invention will simply rotate or flex out of the way. If the Invention was less flexible or were rigidly affixed to the dock or pier, such would not be the case. Another important distinguishing feature of the Invention is that it safely holds the end of the docking line several feet out over the water. This allows easy grasping of the docking line and avoids the potential of the boat colliding with the dock when the crew member is attempting to grab the line, as was the case in the prior art.

Additionally, because the Invention is made of several relatively small pieces, it can be easily disassembled, transported and sorted in a safe place after its use, thereby reducing chances for its misappropriation.

While the Invention has been described with reference to certain preferred characteristics, those skilled in the art will appreciate that certain changes and modifications can be made without departing from the scope and spirit of the Invention as defined by the following claims.

I claim:

1. A portable device placed in the surface of a dock or pier and used to hold and maintain the end of a docking line at a suitable height and position over the water to allow grasping by a crewman standing on an approaching boat, said device comprising, a portable, weighted base, having a top surface and a bottom surface, a peg connected to the top surface of said base, an extension rod connected to said peg, non-skid feet attached to said bottom surface.

2. The device in claim 1 wherein said extension rod is comprised of one or more sections and a hooked end piece, each connected to each other and to said peg on said base.

3. The device in claim 2 wherein the means of connection between the components of the extension rod is a standard pipe coupler into which the opposite ends of the section and the bottom end of the hooked end piece is friction fitted.

4. The device in claim 2 wherein the means of connection between the components of the extension rod is a belled end on one end of each section into which the other end of each section and the bottom end of the hooked end piece is friction fitted.

5. The device in claim 2 wherein the means of connection between the components of the extension rod is a threaded twist collar which is rotated to secure one section to another.

6. The device in claim 2 wherein said extension rod is comprised of hollow tubes having inherent or added buoyancy characteristics.

7. The device in claim 2 wherein said extension rod contains a hooked end piece which is an "S" shaped hollow tube.

8. The device in claim 2 wherein one or more sections may be of smaller diameters than others.

9. The device in claim 1 wherein said base contains a manufacturing hole.

10. The device in claim 1 wherein said peg is attached to said base on the center of the short dimension of said base, at an angle from the vertical and at a distance from the short edge of said base equal to approximately ¼ of the long dimension of said base.

11. The device in claim 1 where said base and other components are finished with anticorrosive material.

* * * * *